United States Patent [19]

Lyons

[11] Patent Number: 4,616,365

[45] Date of Patent: Oct. 14, 1986

[54] WRAP

[76] Inventor: Shirley Lyons, 11064 N. 300 W., Huntington, Ind. 46750

[21] Appl. No.: 723,621

[22] Filed: Apr. 15, 1985

[51] Int. Cl.[4] ..... A41B 13/06

[52] U.S. Cl. ..... 2/69; 2/69.5; 2/243 B

[58] Field of Search ..... 2/69, 69.5, 243 B, 85, 2/84, 88, 93, 115, 227, 211

[56] References Cited

U.S. PATENT DOCUMENTS

| | | | |
|---|---|---|---|
| 1,274,938 | 8/1918 | Rosenberg | 2/69 |
| 1,454,541 | 5/1923 | Falvey | 2/69 |
| 1,584,853 | 5/1926 | Dern | 2/69 |
| 2,442,105 | 5/1948 | Vacheron | 2/69.5 |
| 2,675,552 | 4/1954 | Jackson | 2/69.5 |
| 3,739,399 | 6/1973 | Sheahon | 2/69.5 |
| 4,240,158 | 12/1980 | de Polo | 2/243 B X |

*Primary Examiner*—H. Hampton Hunter

*Attorney, Agent, or Firm*—David A. Lundy; Robert Luke Walker

[57] ABSTRACT

A wrap comprising a plurality of fabric segments. The segments are joined together to form a substantially conchiform or clam shell three-dimensional shape. A kit which can be assembled into the wrap and a pattern for the segments of the wrap are also disclosed.

18 Claims, 4 Drawing Figures

WRAP

BACKGROUND OF THE INVENTION

The present invention relates to blankets and coverlets and more particularly to a wrap having a conchiform or clam shell shape, a kit which can be assembled into the wrap and a pattern for the segments of the wrap.

From time immemorial parents have struggled to find easier ways of wrapping babies and keeping them wrapped. Blankets have some shortcomings. They are hard to spread with one hand while holding a struggling baby with the other arm. They are easy for an older baby to kick apart and generally disorder while he is being wrapped. Blankets also do not surround a small baby's head very well. Buntings solve these problems by enclosing the infant in a hooded sack. However, buntings do not fit well unless they are sized to the infant and it is difficult to get a baby in or out of the bunting, particularly without awakening it when it is asleep.

It is therefore highly desirable to provide an improved wrap that is easy to unfold with one hand, a kit which can be assembled into the wrap and a pattern for the segments of the wrap.

It is also highly desirable to provide an improved wrap that is relatively difficult for an infant to kick into disarray, a kit which can be assembled into the wrap and a pattern for the segments of the wrap.

It is further highly desirable to provide an improved wrap that is relatively easy to remove or place on a baby while it is asleep, a kit which can be assembled into the wrap, and a pattern for the segments of the wrap.

It is likewise highly desirable to provide an improved wrap that will readily surround the head of a small infant, a kit which can be assembled into the wrap, and a pattern for the segments of the wrap.

It would finally be highly desirable to provide an improved wrap that meets all the above desired features.

SUMMARY OF THE INVENTION

It is an object of the invention to provide an improved wrap that is easy to unfold with one hand, a kit which can be assembled into the wrap, and a pattern for the segments of the wrap.

It is another object of the invention to provide an improved wrap that is relatively difficult for an infant to kick into disarray while it is being wrapped, a kit which can be assembled into the warp, and a pattern for the segments of the wrap.

It is yet another object of the invention to provide an improved wrap that is relatively easy to remove or place on a baby while it is asleep, a kit which can be assembled into the wrap, and a pattern for the segments of the wrap.

It is still another object of the invention to provide an improved wrap that will readily surround the head of a small infant, and a kit which can be assembled into the wrap, and a pattern for the segments of the wrap.

It is a further object of the invention to provide an improved wrap that meet all the above features.

In the broader aspects of the invention there is provided an wrap, a kit which can be assembled into the wrap, and a pattern for the segments of the wrap. The wrap has a plurality of fabric segments, joined together to form a substantially conchiform or clam shell three-dimensional shape.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

The wrap 10 of the invention is made of one or more layers of relatively flexible, planar material. The planar material may be cloth, leather, plastic or some other flexible fabric. In alternative embodiments, the wrap 10 of the invention may have a layer of batting between layers of material for a loose fill such as down between layers of material.

The wrap 10 of the invention when supported in wrinkle and fold free configuration has the general shape of a seashell, that is the wrap 10 of the invention is roughly the shape of a warped bowl with a generally concave inside surface 214 and a generally convex outside surface 216. The wrap 10 of the invention may also be described variously as having a conchiform or conchidal or clam shell shape, having the shape of one valve of a bivalve mollusk, and having a shape of a partial ellipsoid with an intrudent margin. The wrap 10 of the invention, in the embodiment described here, is bilaterally symmetrical and formed of bilaterally paired segments 12, 13, 14, 15, 16, 17, 18, 19, 20, 21, 22, 23.

Figure 4:
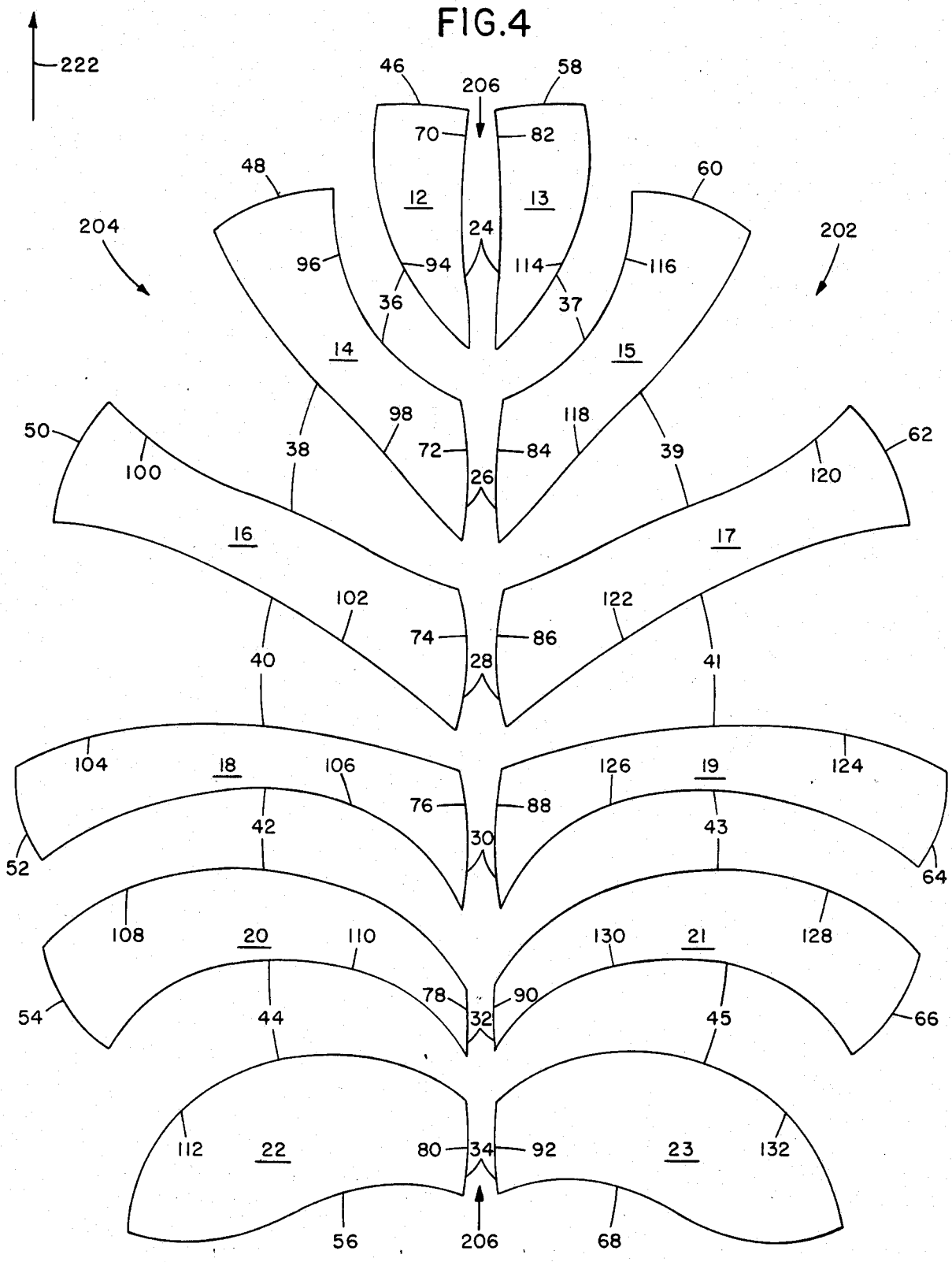
FIG. 4 is an expanded view of an embodiment of the improved wrap of the invention with segments separated by exaggerated seams.

The segments 12–23 are joined together along seams 24, 26, 28, 30, 32, 34, 36, 38, 40, 41, 42, 43, 44, 45. The seams 24–45 join adjacent segments 12–23. The seams 24–45 may be sewn, glued, taped or may employ some other lengthwise connector. The seams 24–45 are positioned pinnately with an overall central seam 206 composed of central seams 24–34 dividing the wrap 10 of the invention into mirror image right and left sides 202, 204 respectively. The segments 12–23 are arranged in bilaterally symmetrical pairs. An embodiment of the invention, as shown in FIG. 4, has two pair of top segments 12–13 and 14–15, three pair of middle segments 16–17 and 18–19 and 20–21 and one pair of bottom segments 22–23. In other embodiments these numbers of segments could be different. The top segments 12–15 together generally define the shape of a portion of an ellipse. The middle segments 16–21 are each roughly falciform, shaped like the blade of a sickle or scythe. The bottom segments 22–23 each have a generally lobate shape. The shapes of the segments 12–23 are illustrated in FIG. 4.

Segments 12, 14, 16, 18, 20, 22, 13, 15, 17, 19, 21, 23 have outer borders 46, 48, 50, 52, 54, 56, 58, 60, 62, 64, 66, 68 respectively and central borders 70, 72, 74, 76, 78,

80, 82, 84, 86, 88, 90, 92 respectively. Segments 12, 13, 22, 23 have lateral borders 94, 114, 112, 132 respectively. Segments 14, 16, 18, 20, 15, 17, 19, 21, have upper lateral borders 96, 100, 104, 108, 116, 120, 124, 128 respectively and lower lateral borders 98, 102, 106, 110, 118, 122, 126, 130 respectively.

Outer borders 46–68 together compose a periphery 208. The following paired lateral borders 94–96, 98–100, 102–104, 106–108, 110–112, 114–116, 118–120, 122–124, 126–128, 130–132 adjoin along seams 36, 38, 40, 42, 44, 37, 39, 41, 43, 45 respectively. The following paired central borders: 70, 82; 72, 84; 74, 86; 76, 88; 78, 90; 80, 92 adjoin along seams 24, 26, 28, 30, 32, 34, respectively.

The overall central seam 206 consists of a first top central seam 24 between the pair of first top segments 12–13, a second top central seam 26 between the pair of second top segments 14–15, a first middle central seam 28 between the pair of first middle segments 16–17, a second middle central seam 30 between the pair of second middle segments 18–19, a third middle central seam 32 between the pair of third middle segments 20–21 and a bottom central seam 34 between the pair of bottom segments 22–23.

When the wrap 10 of the invention is supported in wrinkle and fold free configuration, the overall central seam 206 is substantially coplanar with a plane of bilateral symmetry through the wrap 10. In a specific embodiment of the invention in which a fabric having a grain is used, central seams 24–34 substantially follow the grain of the fabric, that is, segments 12–23 are cut on the bias. In FIG. 4, straight grain of the segments 12–23 is in the direction indicated by arrow 222.

In another specific embodiment of the invention, the first middle central seam 28 and the second middle central seam 30 are each about the same length and are much greater in length than the third middle central seam 32, and the third middle central seam 32 is between about twenty and thirty percent of the length of each of the other two middle central seams 28, 30.

In another specific embodiment of the invention, each of the outer borders 50, 52, 54, 62, 64, 66 of the middle segments 16, 18, 20, 17, 19, 21 has a generally convex shape and the outer borders 56, 68 of bottom segments 22, 23 have a roughly syma or sigmoidal shape.

A generally planar strip or ribbon of edging 212, in one embodiment of the invention 10, is formed into pleats and attached to the periphery 208.

Between the top segments 14, 15 and middle segments 16, 17 are top middle seams 38, 39. Top middle seams 38, 39 are generally concave toward top segments 14, 15 respectively. Between the middle segments 20, 21 and bottom segments 22, 23 are middle bottom seams 44, 45. Middle bottom seams 44, 45 are generally concave toward bottom segments 22, 23 respectively. In an embodiment of the invention in which there are three pair of middle segments 16–17, 18–19, 20–21, there are a pair of first middle-second middle seams 40, 41, and a pair of second middle-third middle seams 42, 43. In another embodiment of the invention, the first middle-second middle seams 40, 41 are longer than the top middle seams 38, 39 but shorter than the second middle-third middle seams 42, 43. In that embodiment, the second middle-third middle seams 42, 43 are longer than the middle-bottom seams 44, 45.

In an embodiment of the invention in which there are two pair of top segments 12–13 and 14–15 there is a pair of top-top seams 36, 37.

In one embodiment of the invention, an order of relative lengths from greater to lesser is second middle-third middle seams 42, 43, first middle-second middle seams 40, 41 middle bottom seams 44, 45, top middle seams 38, 39.

A kit which is capable of being assembled into the wrap 10 of the invention has segments 12–23, but segments 12–23 are not joined together by seams 24–45. In some embodiments of the kit of the invention 10, such as those with sewn seams 24–45, it is desirable to provide a margin of extra fabric around borders 70–132 to permit overlap of fabric at seams 24–45. In some embodiments of the kit of the invention the margins of segments 24–45 are all of a piece and require separating before segments 12–23 can be joined together. The kit is assembled by concatenating the segments. Segments 12–23 are concatenated with the following pairs of adjacent borders: 70, 82; 72, 84; 74, 86; 76, 88; 78, 90; 80, 92; 94, 96; 98, 100; 102, 104; 106, 108; 110, 112; 114, 116; 118, 120; 122, 124; 126, 128; 130, 132 to form seams 24, 26, 28, 30, 32, 34, 36, 38, 40, 42, 44, 37, 39, 41, 43, 45 respectively by sewing, gluing, taping or using some other lengthwise connector.

A pattern for the wrap 10 of the invention has indicia of segments 12–23 on a planar material such as paper or cloth. In a specific embodiment of the invention, the pattern is a template superimposable upon fabric for a transference of the indicia of segments 12–23 unto the fabric to provide the wrap 10 of the invention in kit form as discussed above.

The wrap 10 of the invention can be made to any particular dimensions desired and can then be wrapped to a range of sizes. For example, a wrap 10 of the invention could be dimensioned variously to accommodate newborns and younger infants, or premature infants, or older children or adults.

Figure 1:
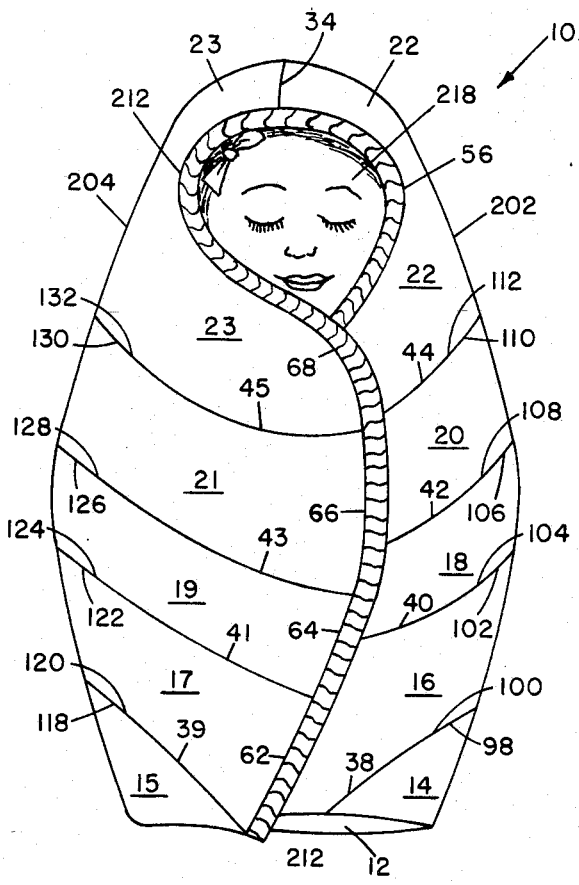
FIG. 1 is a perspective view of the improved wrap of the invention in a first orientation wrapped around an infant.

The wrap 10 of the invention may be used in either a first or a second orientation. In the first orientation as in FIG. 1, the wrap 10 is enfolded about infant 220 with the infant's head adjacent bottom segments 22, 23. The wrap 10 is spread open and the infant 218 is placed on the wrap 10. Top segments 12, 13 are folded over the feet of the infant 218, and then one side 202 or 204 of the wrap 10 is folded over and around infant 220 partially overlapping the other side 204 or 202. In this first orientation the shape of the wrap is such that the head of the infant 218 will tend to be enfolded by the motions of folding over sides 202, 204 without an additional motion to specifically enfold the head. It is envisioned that the first orientation of the wrap 10 about an infant 218 is generally more useful for a smaller less active infant 218 for whom protection of the head is desired.

Figure 2:
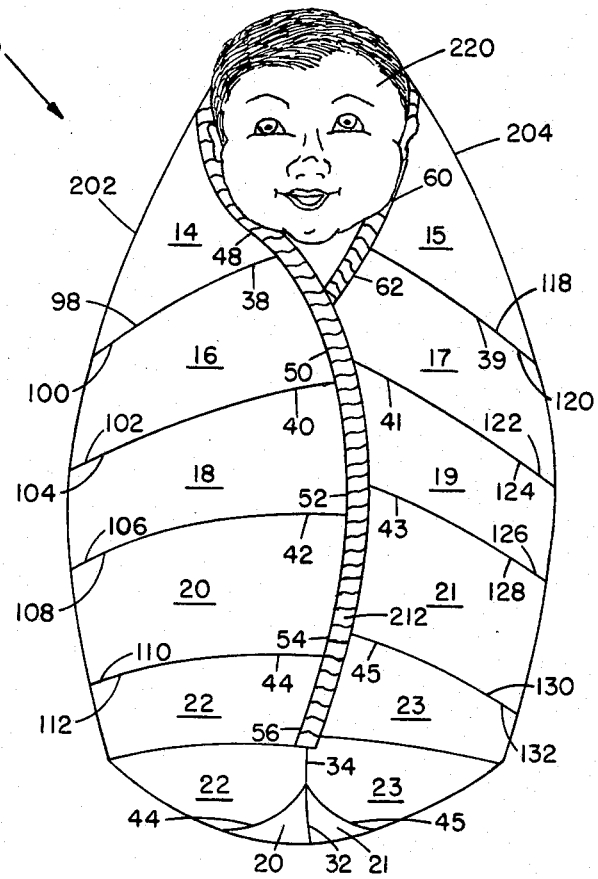
FIG. 2 is a perspective view of the improved wrap of the invention in a second orientation wrapped around an infant.
Figure 3:
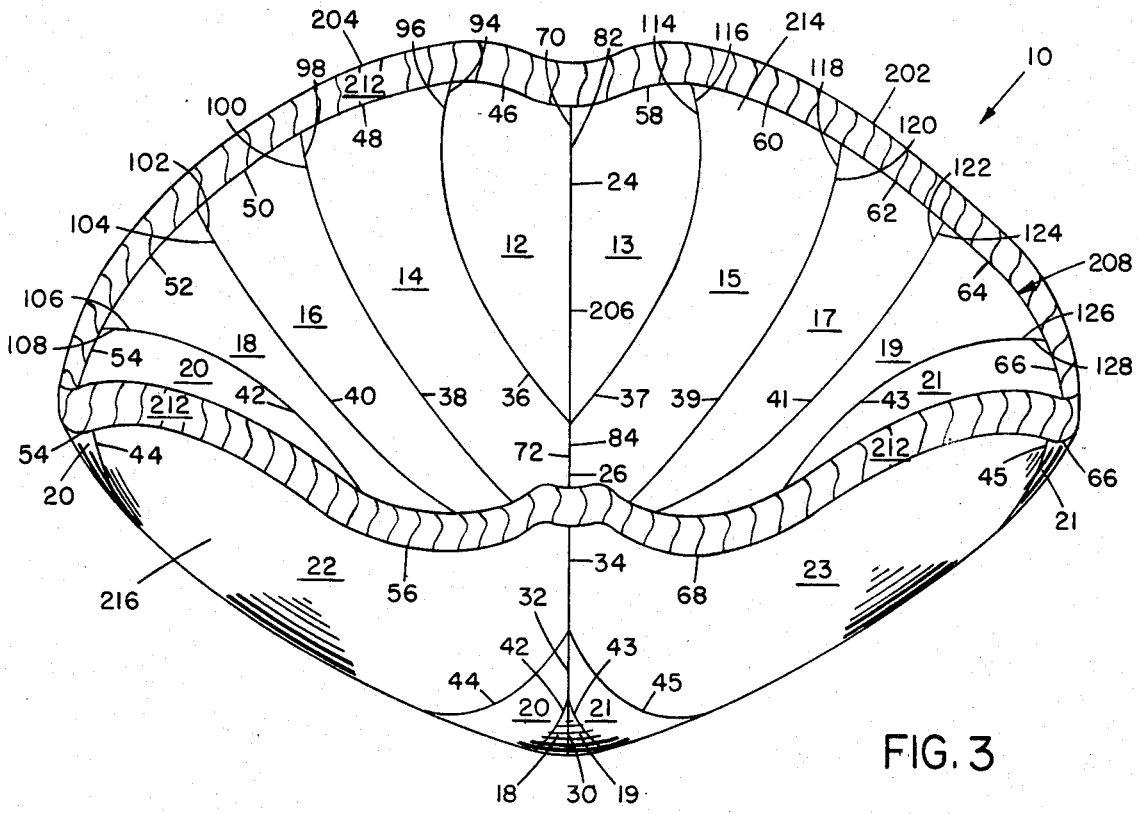
FIG. 3 is a perspective view of the wrap of the invention when supported in wrinkle and fold free configuration.

In the second orientation as in FIG. 2, the wrap 10 is enfolded about the infant 220 by placing infant 220 on the wrap 10 with the infant's head adjacent top segments 12–15, folding one side 202 or 204 of the wrap 10 over and around infant 220, and partially overlapping the other side 204 or 202. The shape of the wrap 10 is such that the motions of folding the sides 202, 204 over infant 220 will tend to enfold the feet of infant 220 without an additional motion to specifically enfold the feet. It is envisioned that the second orientation of the wrap 10 about an infant 220 is generally more useful for an older more active infant 220 for whom head coverage was not necessary.

While a specific embodiment of the invention has been shown and described herein for purposes of illustration, it is desired that protection afforded by any patent which may issue upon this application not be limited strictly to the disclosed embodiment; but that it extend to all structures and arrangements which contain the essence of the invention and which fall fairly within the scope of the claims which are appended hereto:

What is claimed is:

1. A wrap comprising a plurality of segments of relatively flexible planar material, said segments being joined together by lengthwise connectors, said wrap having a substantially three-dimensional conchiform or clamshell shape when said wrap is not being worn and is supported in generally wrinkle and fold free configuration, said segments being joined together as bilaterally arranged pairs, and said segments comprising top, middle and bottom segment pairs, each pair being dissimilar in shape form the other pairs.

2. The wrap of claim 1 wherein siad clamshell three-dimensional shape is bilaterally symmetrical.

3. The wrap of claim 1 further comprising pinnate seams joining together said segments.

4. The wrap of claim 1 wherein said top segments further comprise a pair of first top segments and a pair of second top segments, and said middle segments further comprise a pair of first middle segments, a pair of second middle segments and a pair of third middle segments.

5. The wrap of claim 4 further comprising a pair of top middle seams joining a pair of said top segments to a pair of said middle segments, and a pair of middle bottom seams joining a pair of said middle segments to a pair of said bottom segments, said top middle seams each being generally concave toward said top segments, said middle bottom seams each being generally concave toward said bottom segments.

6. The wrap of claim 5 further comprising a pair of first middle-second middle seams joining said first middle segments to said second middle segments, and a pair of second middle-third middle seams joining said second middle segments to said third middle segments, said first middle-second middle seams being longer than said top-middle seams, said first middle-second middle seams being shorter than second middle-third middle seams, said second middle-third middle seams being longer than said middle-bottom seams.

7. The wrap of claim 6 wherein the order of relative length of said seams from greater to lesser is: second middle-third middle seam, first middle-second middle seam, bottom-middle seam, top-middle seam.

8. The wrap of claim 4 further comprising a first middle central seam between said pair of first middle segments, a second middle central seam between said pair of second middle segments, a third middle central seam between said pair of third middle segments, said third middle central seam being shorter than said first middle central seam, said third middle central seam being shorter than second middle central seam.

9. The wrap of claim 8 wherein said third middle central seam is less than between twenty and thirty percent of the combined length of said first middle central seam and said second middle central seam.

10. The wrap of claim 1 wherein said top segments together generally define the shape of a portion of an ellipse, said middle segments each having a roughly falciform shape, and said bottom segments each having a generally lobate shape.

11. The wrap of claim 1 wherein said segments each further comprise a plurality of layers.

12. The wrap of claim 1 wherein said fabric has a grain and said segments each have central borders substantially following said grain.

13. A pattern for a wrap, said pattern comprising planar material having indicia of a plurality of segments, said segments having outer borders, central borders, and lateral borders, said segments being reproducable in relatively flexible planar material wherein respective pairs of said central borders and respective pairs of said lateral borders are joinable to concatenate said segments and form said wrap, said wrap having a substantially conchiform or clam shell three-dimensional shape when said wrap is supported in wrinkle and fold free configuration.

14. The pattern of claim 13 wherein said conchiform or clam shell three-dimensional shape is bilaterally symmetrical.

15. The pattern of claim 13 wherein said segments further comprise top segments, middle segments and bottom segments, said top segments being dissimilar in shape from said middle segments and said bottom segments and said middle segments being dissimilar in shape from said bottom segments.

16. The pattern of claim 13 further comprising two pairs of top segments, a pair of first middle segments, a pair of second middle segments, a pair of third middle segments, on a pair of bottom segments, said top segments, said third middle segments and said bottom segments having generally concave lateral borders.

17. The pattern of claim 13 wherein said middle segments each have a roughly falciform shape, and said bottom segments each have a generally lobate shape.

18. The pattern of claim 13 wherein said segments have about the shapes illustrated in FIG. 4.

* * * * *